US006382773B1

(12) United States Patent
Chang et al.

(10) Patent No.: US 6,382,773 B1
(45) Date of Patent: May 7, 2002

(54) METHOD AND STRUCTURE FOR MEASURING TEMPERATURE OF HEATER ELEMENTS OF INK-JET PRINTHEAD

(75) Inventors: Charles C. Chang; Chieh-Wen Wang; Shyh-Haur Su, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/704,027

(22) Filed: Nov. 3, 2000

(30) Foreign Application Priority Data

Jan. 29, 2000 (TW) ..... 89101545 A

(51) Int. Cl.[7] ..... B41J 2/05
(52) U.S. Cl. ..... 347/57; 347/58
(58) Field of Search ..... 347/14, 17, 19, 347/57–59, 50

(56) References Cited

U.S. PATENT DOCUMENTS

| | | | | |
|---|---|---|---|---|
| 4,791,435 A | | 12/1988 | Smith et al. | 347/17 |
| 4,910,528 A | | 3/1990 | Firl et al. | 347/17 |
| 5,045,870 A | | 9/1991 | Lamey et al. | 347/59 |
| 5,107,276 A | | 4/1992 | Kneezel et al. | 347/60 |
| 5,168,284 A | | 12/1992 | Yeung | 347/17 |
| 5,175,565 A | | 12/1992 | Ishinaga et al. | 347/67 |
| 5,211,812 A | | 5/1993 | Vielberth et al. | 202/172 |
| 5,475,405 A | | 12/1995 | Widder et al. | 347/14 |
| 5,635,968 A | * | 6/1997 | Bhaskar et al. | 347/59 |
| 5,734,391 A | * | 3/1998 | Tanaka et al. | 347/14 |
| 5,736,995 A | | 4/1998 | Bohorquez et al. | 347/14 |

* cited by examiner

*Primary Examiner*—John Barlow
*Assistant Examiner*—Juanita Stephens
(74) *Attorney, Agent, or Firm*—Birch, Stewart, Kolasch & Birch, LLP

(57) ABSTRACT

A method and a structure for measuring the temperature of heating elements of an ink-jet printhead are provided, wherein an extra metal layer or semiconductor layer is formed on the ink-jet chip having driving elements to precisely measure the temperature of each individual heating element. The structure includes: an ink-jet device including a heating element for heating liquid ink; a transistor driver for driving a transistor to control heating of the heating element; and a temperature-sensing layer located between the ink-jet device and the transistor driver and under the heating element, the temperature-sensing layer having two terminals, one connecting to the transistor and the other connecting to an electrode terminal connected to a printer, wherein the ink-jet device connects to the transistor driver through the temperature-sensing layer.

19 Claims, 7 Drawing Sheets

METHOD AND STRUCTURE FOR MEASURING TEMPERATURE OF HEATER ELEMENTS OF INK-JET PRINTHEAD

BACKGROUND OF THE INVENTION

1. Field of the invention

This invention relates generally to adjusting the volume of ink droplets ejected from a printhead, and more particularly to precisely measuring the temperature of heater elements of an ink-jet printhead.

2. Description of prior art

Ink-jet printers of the type usually referred to as drop-on-demand, such as piezoelectric, acoustic, phase change wax-based or thermal, have at least one printhead from which droplets of ink are directed towards a recording sheet. Within the printhead, the ink is contained in a plurality of channels. For a drop-on-demand printhead, power pulses cause the droplets of ink to be expelled as required from nozzles or orifices at the end of the channels. In a thermal printer, the power pulses are usually produced by formation and growth of vapor bubbles on heating elements or resistors, each located in a respective channel, which are individually addressable to heat and vaporize ink in the channels. As voltage is applied across a selected resistor, a vapor bubble grows in the associated channel and initially expels the ink therein from the channel orifice, thereby forming a droplet moving in a direction away from the channel orifice and towards the recording medium where, upon hitting the recording medium, a dot or spot of ink is deposited. Following collapse of the vapor bubble the channel is refilled by ink from a supply container of liquid ink.

The uniformity of the ink jet significantly affects the printing quality, especially for a high-resolution printhead. The volume of the ink droplet depends on the applied voltage, as well as the initial temperature of heating elements. The circumference of a heating element and the duration of its use influence its temperature, which will rise while continuously ejecting the ink droplets. Therefore, adjusting the temperature of the heating elements can change the driving manner of an ink-jet printhead.

Refer to FIG. 1. In the prior-art, the average temperature of a thermal ink-jet chip 10 is measured. In the drawing, reference number 102 indicates an electrode area, reference number 103 indicates a temperature-sensing resistor, reference number 104 indicates an ink-jet circuit area, reference number 105 indicates a driving device area, reference number 106 indicates a heating elements area, and reference number 107 indicates an opening of supply container of liquid ink.

Regarding the sensing and control of temperature, the prior art, e.g. U.S. Pat. No. 4,791,435, U.S. Pat. No. 4,910,528, U.S. Pat. No. 5,107,276, U.S. Pat. No. 5,168,284, U.S. Pat. No. 5,175,565, U.S. Pat. No. 5,475,405, U.S. Pat. No. 5,736,995 and soon, only consider the average temperature. In all of the prior arts, heating elements are pre-heated to keep above a certain temperature in accordance with the feedback of the average temperature of the ink-jet chip when the heating elements are used. Furthermore, the ink-jet printer is paused to cool the printhead down if the average temperature gets too high as described in U.S. Pat. No. 4,910,528. However, only considering the average temperature is not enough for the printhead since each of the individual heating elements might be used for different durations.

In a high-resolution printhead, there are many heating elements. Driving circuits such as switching circuits of MOS transistors are usually formed on the ink-jet chip as described in U.S. Pat. No. 5,045,870 and U.S. Pat. No. 5,211,812. Refer to FIG. 2, which is a cross-sectional diagram of a MOS transistor in a structure measuring the temperature of heating elements of an ink-jet printhead. In the drawing, reference number 21 indicates a silicon substrate, reference number 22 indicates a field oxide, reference number 23 indicates a thermal oxide, reference number 24 indicates a polysilicon gate, reference number 27 indicates a resistive layer, and reference number 28 indicates a conductive layer. In the prior-art method, MOS driving elements are first formed on the ink-jet chip. One terminal of the ink-jet circuit connects to the drain of MOS transistor and another terminal connects to the driving voltage, so that a voltage is applied across the heating elements when a high voltage is applied to the gate of MOS transistor. Thus, an ink droplet is ejected from the channel nozzle. In order to provide a good printing quality, this kind of ink-jet printhead utilizes temperature-sensing feedback, so as to properly drive the resistors, also known as heaters, to produce uniform sized ink droplets.

It is possible to form a temperature-sensing device near each individual heating element in a prior-art ink-jet printhead. However, a large amount of terminals equal to the number of the heating elements have to be provided on the ink-jet chip to connect to the printer circuit. This is impractical for an ink-jet printhead having several ten to even several hundred of heating elements.

SUMMARY OF THE INVENTION

Accordingly, the object of this invention is to provide a method and a structure for measuring the temperature of heating elements of an ink-jet printhead, which can precisely measure the temperature of each individual heating element on the ink-jet printhead.

To achieve the above object, an extra metal layer or semiconductor layer is formed on the ink-jet chip having driving elements to precisely measure the temperature of each individual heating element. The metal layer or semiconductor layer can be wound under or near the heaters and connects to the driving elements. By controlling the line width, the method and structure can be used to measure the-temperature of any heating element while the ink droplet is ejected, wherein only one terminal need to be connected to the printer on the ink-jet chip. Thus, the temperature-sensing signal of any heating element can be transmitted to the printer. By using this technology, the size of ink droplets ejected from each individual heating element is uniform, thereby achieving high-quality printing.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS.

The following detailed description, given by way of example and not intended to limit the invention solely to the embodiments described herein, will best be understood in conjunction with the accompanying drawings which are given by way of illustration only, and thus are not limitative of the present invention, and in which.

DETAILED DESCRIPTION OF THE PREFERRED EMBODIMENTS

Figure 1:
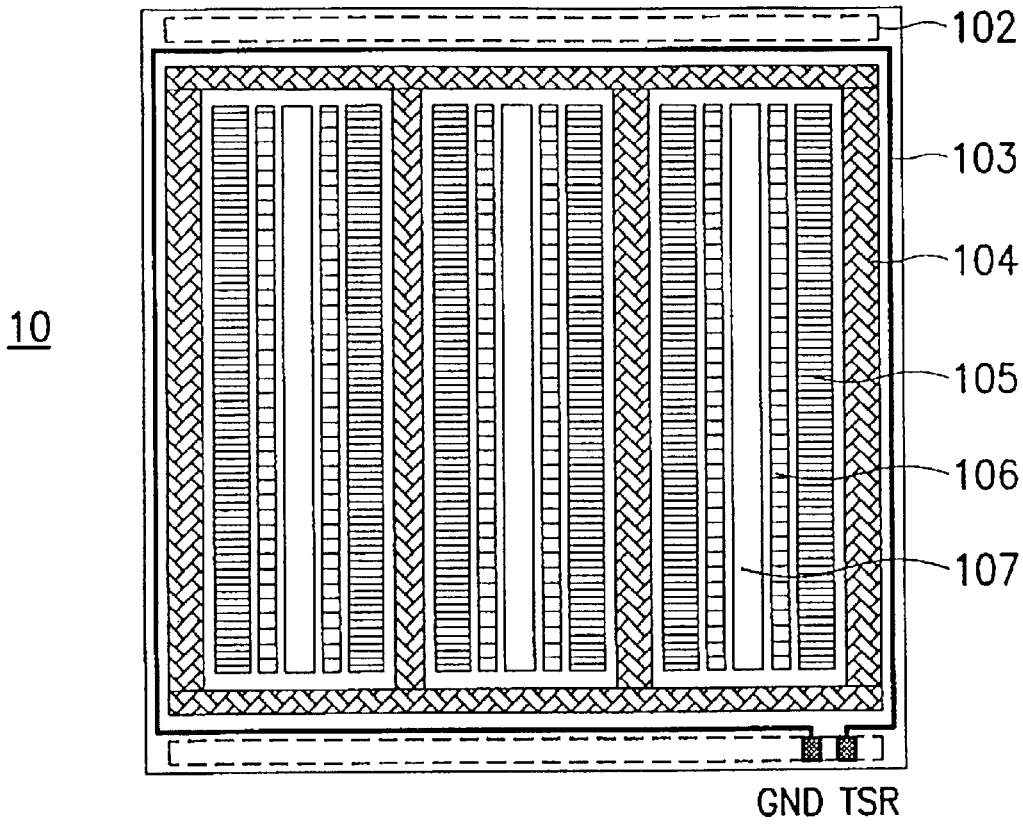
FIG. 1 is a diagram illustrating a conventional structure for measuring the temperature of heating elements of a thermal ink-jet printhead.
Figure 2:
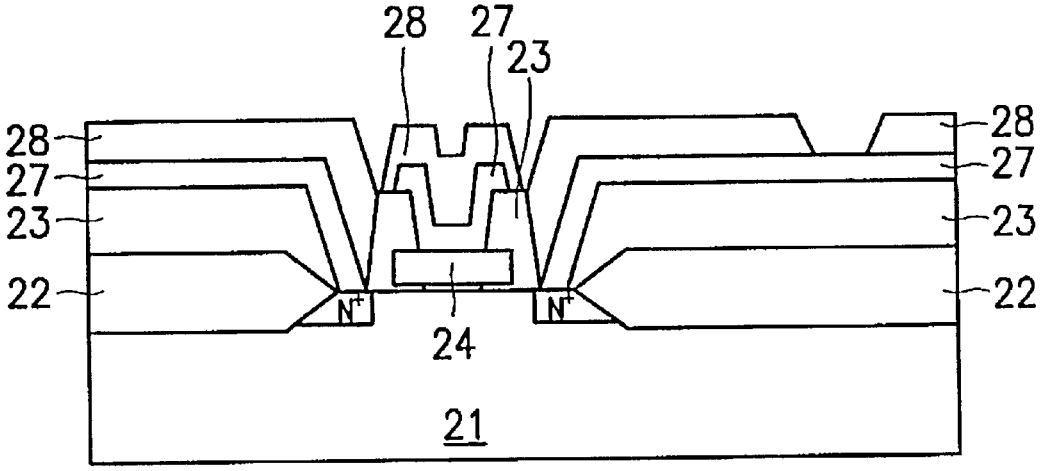
FIG. 2 is a cross-sectional view of a MOS transistor in the conventional structure for measuring the temperature of heating elements of a thermal ink-jet-printhead.
Figure 3A:
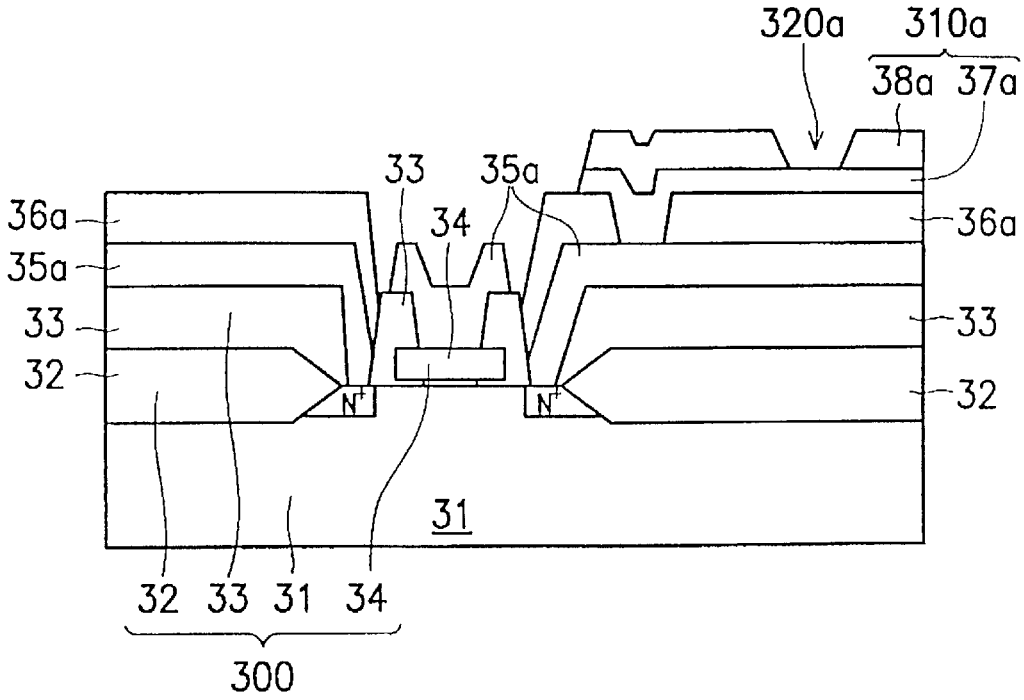
FIG. 3*a* is a cross-sectional view of a MOS transistor in the structure for measuring the temperature of heating elements of a thermal ink-jet printhead according to one embodiment of this invention.

Referring to FIG. 3*a*, according to one embodiment of this invention, the structure for precisely measuring the temperature of heating elements of an ink-jet printhead comprises: an ink-jet device 310*a* having a resistive layer 37*a* and a conductive layer 38*a* for heating liquid ink; a transistor driver 300 for driving a transistor to control whether the ink-jet device is heated; and a temperature-sensing layer 35*a*, located between the transistor driver 300 and the ink-jet device 310*a* and mainly positioned below the resistor 320*a*, having one terminal thereof connected to the transistor (MOS) and another terminal thereof connected to an electrode terminal (TSR) connected to the printer. The ink-jet device 310*a* connects to the transistor driver 300 through the temperature-sensing layer 35*a*.

Figure 4A:
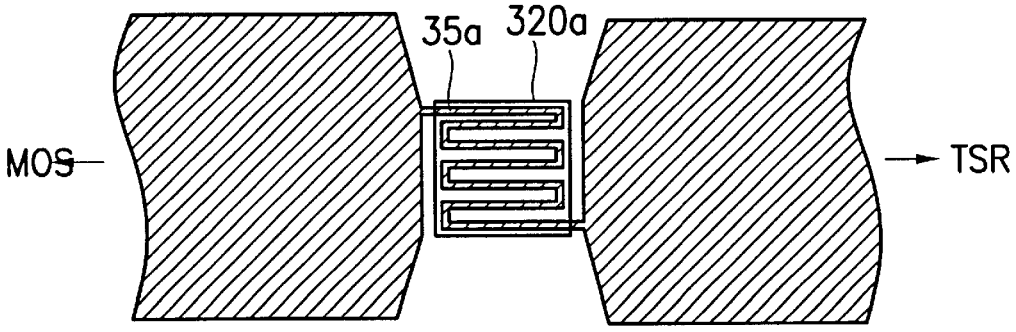
FIG. 4*a* is a layout diagram of the vicinity of the heating elements in the structure of FIG. 3*a;*

The temperature-sensing layer 35*a* is a metal layer or a semiconductor layer formed between the ink-jet device 310*a* and the driver 300. The ink-jet device 310*a* includes a resistive layer 37*a* and a conductive layer 38*a*. The driver 300 includes a field oxide layer 32, a thermal oxide layer 33 and a polysilicon gate 34 formed on the silicon substrate 31. Furthermore, a dielectric layer 36*a* is formed between the temperature-sensing layer 35*a* and the ink-jet device 310*a*. The dielectric layer 36*a* comprises at least one layer selected from a group of $Si_3N_4$, $SiO_2$, organic glass, borophosphosilicate glass, $Al_2O_3$, $Ta_2O_5$ and $TiO_2$. Since the metal layer or semiconductor layer serving as the temperature-sensing layer 35*a* and the ink-jet device 310*a* are located at different planes, the temperature-sensing layer 35*a* can be formed as a winding under the heating element. Referring to FIG. 4*a*, the temperature-sensing layer 35*a* under the heating element 320*a* is thinner and longer than at the other positions. The resistance of the temperature-sensing layer 35*a* therefore almost falls on the winding under the heating element 320*a*.

Figure 4B:
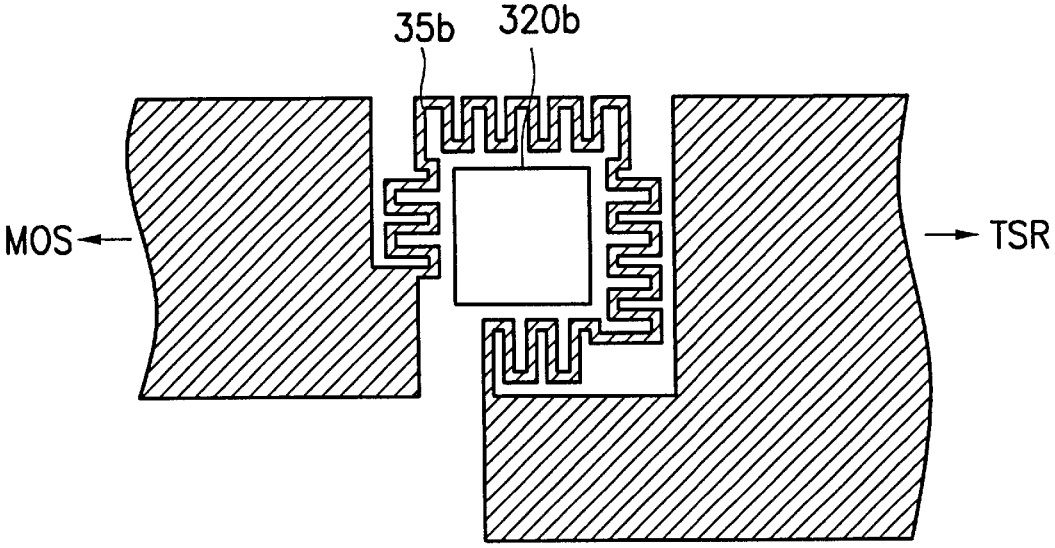
FIG. 4*b* is a layout diagram of the vicinity of the heating elements in the structure of FIG. 3*b;*

The temperature-sensing layer 35*b* is a metal layer or a semiconductor layer formed between the ink-jet device 310*b* and the driver 300. The ink-jet device 310*b* includes a resistive layer 37*b* and a conductive layer 38*b*. A dielectric layer 36*b* is formed between the temperature-sensing layer 35*b* and the ink-jet device 310*b*. Since the metal layer or semiconductor layer serving as the temperature-sensing layer 35*b* and the ink-jet device 310*b* are located at different planes, the temperature-sensing layer 35*b* can be formed as a winding in the vicinity of the heating element. Referring to FIG. 4*b*, the temperature-sensing layer 35*b* in the vicinity of the heating element 320*b* is thinner and longer than at the other positions. The resistance of the temperature-sensing layer 35*b* therefore almost falls on the winding under the heating element 320*b*.

Next, according to one embodiment of this invention, the method for measuring the temperature of an individual heating element of an ink-jet printhead comprises the steps of: (i) forming a temperature-sensing layer under or near each individual heating element; (ii) connecting one terminal of the temperature-sensing layer to one terminal of a transistor, connecting the other terminal of the temperature-sensing layer to an electrode terminal connected with a printer, and connecting the other terminal of the transistor to a ground terminal; (iii) connecting each transistor corresponding to each temperature-sensing layer to a different transistor switch terminal and ground terminal as a matrix, in which each pair of a transistor switch terminal and ground terminal can control a loop from the electrode terminal through the temperature-sensing layer to ground; and (iv) measuring the resistance of a certain temperature-sensing layer at the electrode terminal through the choice of transistor switch terminal and ground terminal so that the temperature of the heating element can be obtained.

Figure 5:
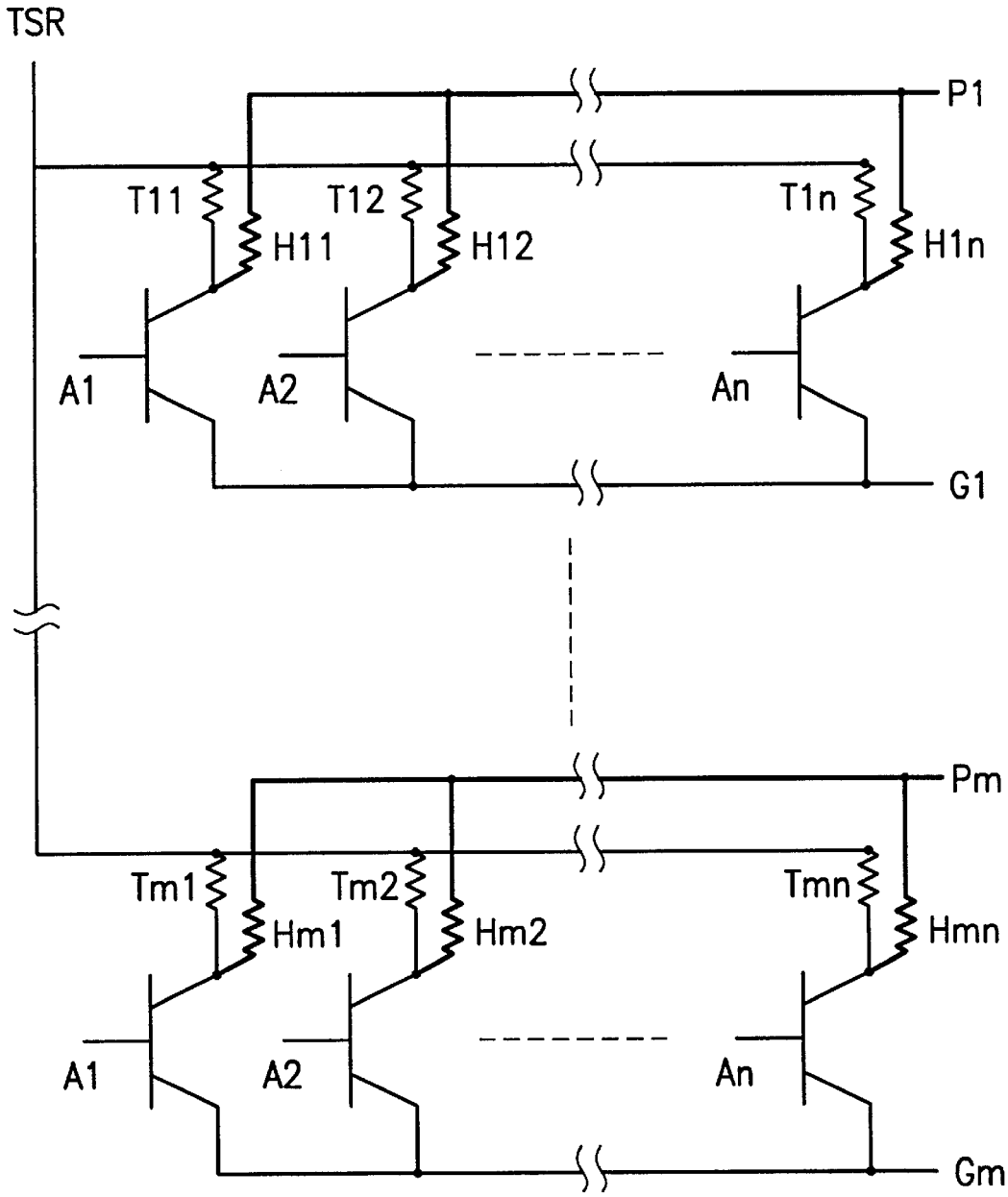
FIG. 5 is an equivalent circuit diagram of the structure for measuring the temperature of heating elements of a thermal ink-jet printhead according to this invention.

In order to reduce the number of terminals connected to the printer, the temperature-sensing layer 35*a* or 35*b* can be directly connected to the electrode of MOS transistor through the transistor driver 300. The logic circuit of the ink-jet chip is as shown in FIG. 5. In the drawing, the resistance T11 is measured so that the temperature of the individual heating element H11 can be obtained if the gate electrode Al is high level and the other gate electrodes A2~An are low level, and the ground electrode G1 is grounded and the other ground electrodes G2~Gm are open.

The temperature-sensing layer 35*a* or 35*b* has a smaller line width in the vicinity of the heating element than at the other positions. Thus, the resistance variation is mainly caused by the temperature variation of the heating element. The resistance of the temperature-sensing layer is larger than 50 ohm in room temperature, and is preferably larger than 100 ohm.

Figure 3B:
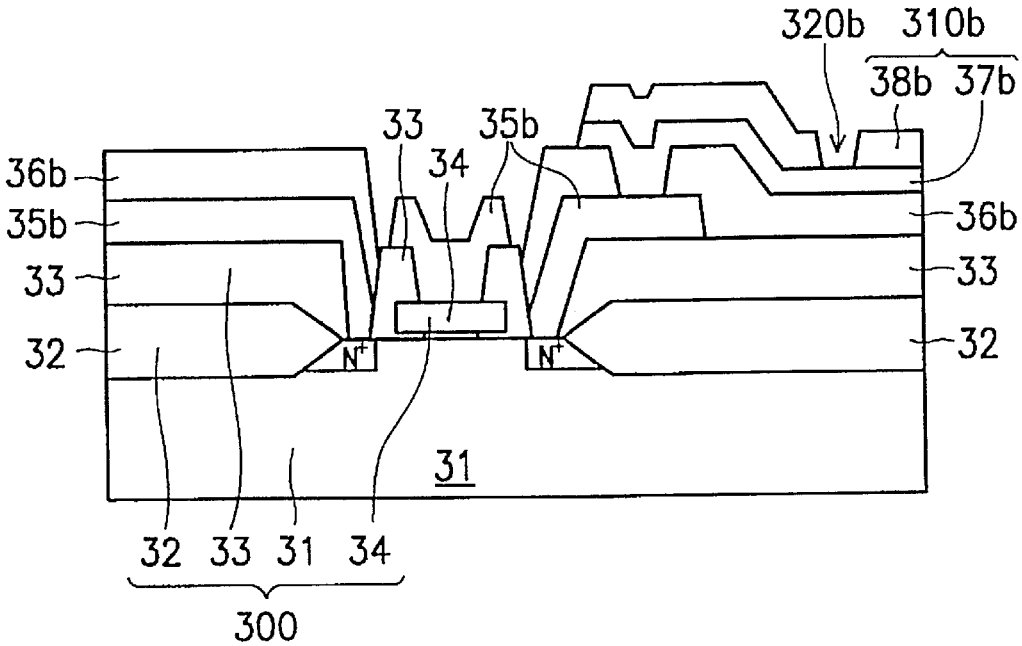
FIG. 3*b* is a cross-sectional view of a MOS transistor in the structure for measuring the temperature of heating elements of a thermal ink-jet printhead according to another embodiment of this invention.

In FIGS. 3*a* and 3*b*, the temperature-sensing layer 35*a* and, 35*b* are respectively connected to the temperature-sensing electrode terminal (TSR) and the ground electrode terminal (G) of the ink-jet chip. However, the temperature-sensing layer can connect to the electrode terminal through some metal layers of ink-jet device, e.g. the metal layers 37*a*, 37*b*, or 38*a*, 38*b*, but not directly connect to the electrode terminal.

Figure 6:
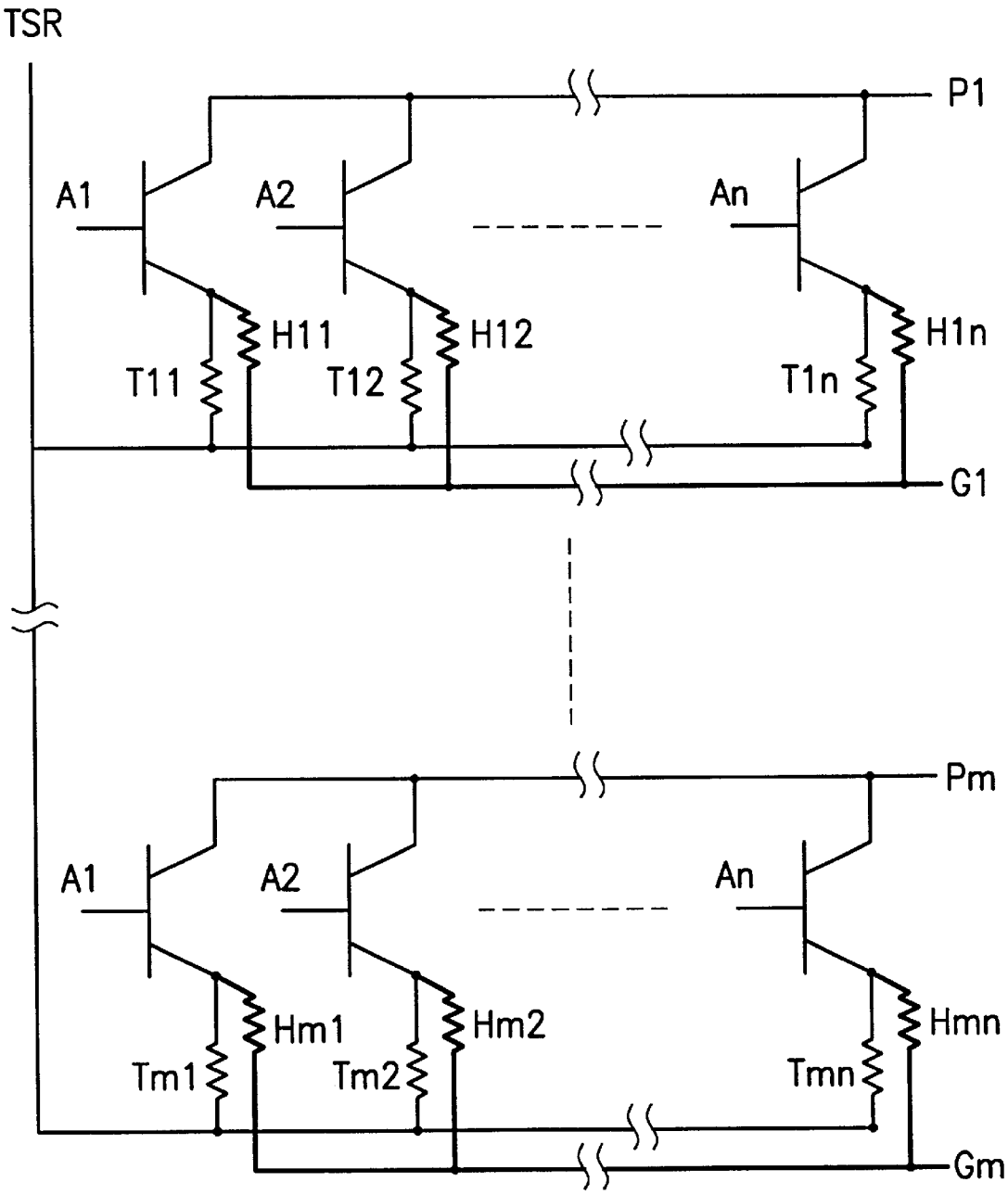
FIG. 6 is another equivalent circuit diagram of the structure for measuring the temperature of heating elements of a thermal ink-jet printhead according to this invention.

Moreover, instead of being located between the power supply electrode P and the drain of MOS transistor as shown in FIG. 5, the resistor, i.e. heating element, can be located between the source of the MOS transistor and the ground. In this case, one terminal of the temperature-sensing layer has to be connected to the source of the MOS transistor. As shown in FIG. 6, the temperature measurement of the heating element is determined by the resistance between the temperature-sensing electrode terminal TSR and the power supply electrode P while the corresponding gate is high level.

Figure 7:
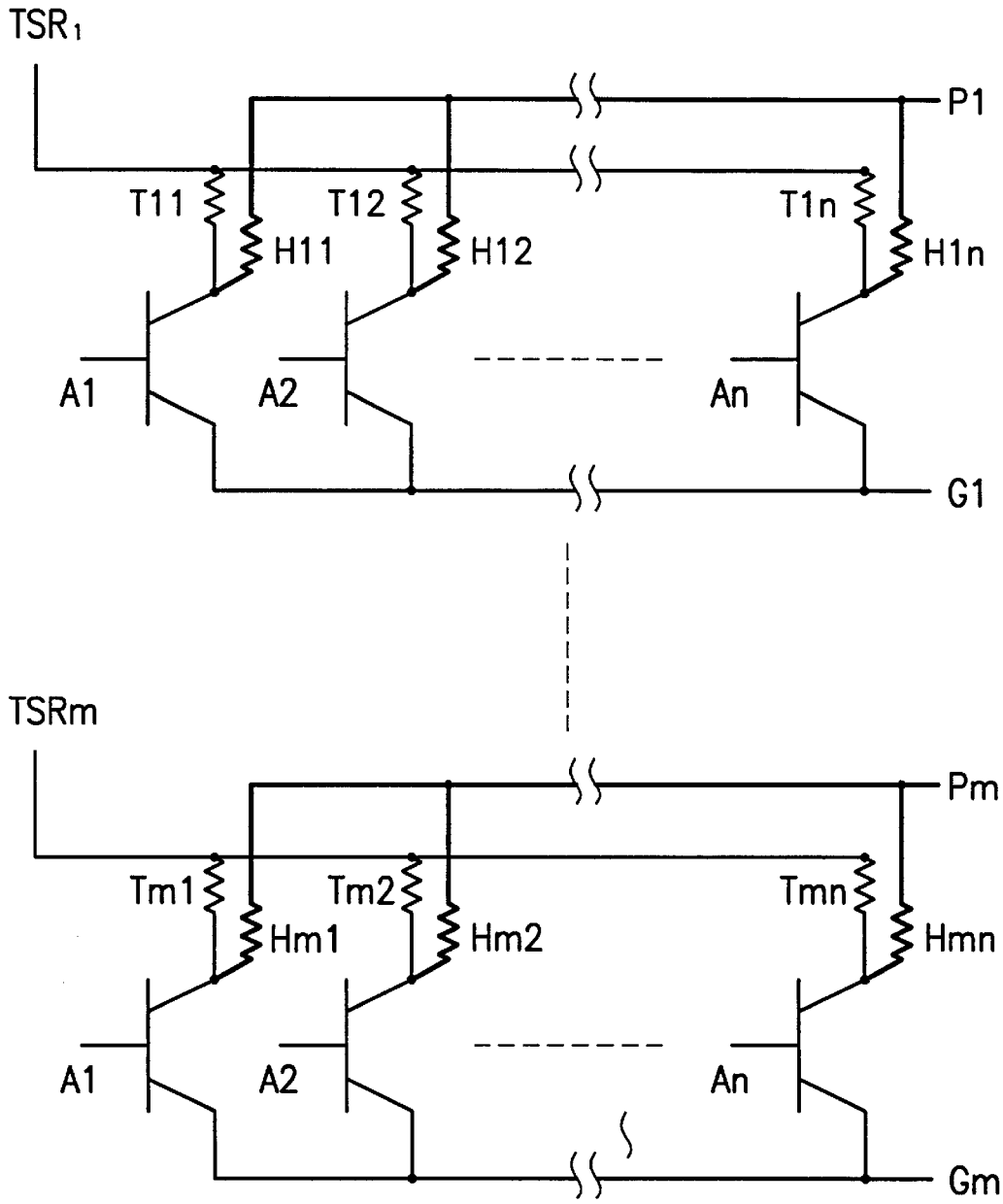
FIG. 7 is another equivalent circuit diagram of the structure for measuring the temperature of heating elements of a thermal ink-jet printhead according to this invention.
Figure 8:
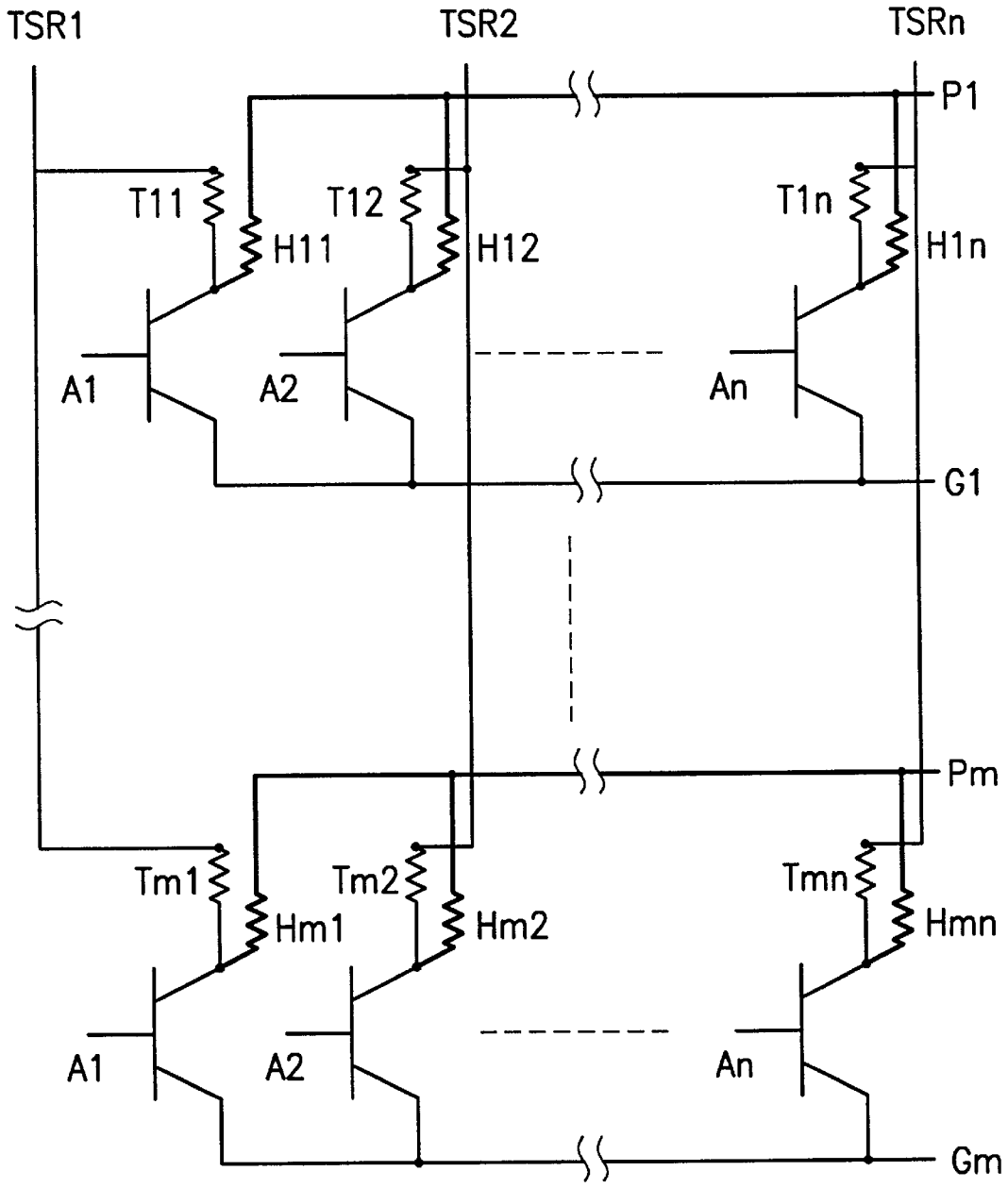
FIG. 8 is an equivalent circuit diagram of the structure for measuring the temperature of heating elements of a thermal ink-jet printhead according to this invention.

In another embodiment, in order to increase the number of heating elements to be measured at the same time, the number of the temperature-sensing electrode terminals can be increased. For example, every temperature-sensing layer controlled by a ground electrode is connected to the temperature-sensing electrode terminal TSR corresponding to the ground electrode terminal G as shown in FIG. 7. The temperature of m heating elements can be simultaneously measured if a gate A is high level and m ground electrodes G are ground. In another embodiment, every temperature-sensing layer controlled by every gate A is connected to the corresponding temperature-sensing electrode terminal TSR of the gate as shown in FIG. 8. The temperature of n heating elements can be simultaneously measured if, a ground electrode G is ground and n gates Al~An are high level.

This invention has the following advantages: First, the temperature of any heating element can be obtained using a single electrode by using the driver circuit of a high-resolution ink-jet printhead, so that precise control of ink-ejection in accordance with the temperature of each individual heating element can be achieved. Second, the use of an extra metal layer or semiconductor layer allows the fabrication of drivers and ink-jet devices in different wafer factory under a larger tolerance of alignment accuracy. It is therefore possible to integrate equipment on hand when manufacturing the printhead of this invention.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. An ink-jet printhead comprising:

an ink-jet device including a heating element for heating liquid ink;

a transistor driver for driving a transistor to control heating of the heating element; and a temperature-sensing layer located between the ink-jet device and the transistor driver and under the heating element, the temperature-sensing layer having two terminals, one connecting to the transistor and the other connecting to an electrode terminal connected to a printer, wherein the ink-jet device connects to the transistor driver through the temperature-sensing layer.

2. An ink-jet printhead as claimed in claim 1 wherein the temperature-sensing layer is made of metal.

3. An ink-jet printhead as claimed in claim 1 wherein the temperature-sensing layer comprises a semiconductor layer.

4. An ink-jet printhead as claimed in claim 1 wherein the temperature-sensing layer comprises a line width and the line width at a vicinity of the heating element is thinner than at other places.

5. An ink-jet printhead as claimed in claim 1 wherein a dielectric layer is formed between the temperature-sensing layer and the ink-jet device.

6. An ink-jet printhead as claimed in claim 5 wherein the dielectric layer comprises at least one layer selected from a group consisting of $Si_3N_4$, $SiO_2$, organic glass, borophosphosilicate glass, $Al_2O_3$, $Ta_2O_5$ and $TiO_2$.

7. An ink-jet printhead comprising:

an ink-jet device including a heating element for heating liquid ink;

a transistor driver for driving a transistor to control heating of the heating element; and a temperature-sensing layer located between the ink-jet device and the transistor driver and at a vicinity of the heating element, the temperature-sensing layer having two terminals, one connecting to the transistor and the other connecting to an electrode terminal connected to a printer, wherein the ink-jet device connects to the transistor driver through the temperature-sensing layer.

8. An ink-jet printhead as claimed in claim 7 wherein the temperature-sensing layer is made of metal.

9. An ink-jet printhead as claimed in claim 7 wherein the temperature-sensing layer comprises a semiconductor layer.

10. An ink-jet printhead as claimed in claim 7 wherein the temperature-sensing layer comprises a line width and the line width at the vicinity of the heating element is thinner than at other places.

11. An ink-jet printhead as claimed in claim 7 wherein a dielectric layer is formed between the temperature-sensing layer and the ink-jet device.

12. An ink-jet printhead as claimed in claim 11 wherein the dielecric layer comprises at least one layer selected from a group consisting of $Si_3N_4$, $SiO_2$, organic glass, borophosphosilicate glass, $Al_2O_3$, $Ta_2O_5$ and $TiO_2$.

13. A method for measuring the temperature of an individual heating element of an ink-jet printhead comprising the steps of:

(i) forming a temperature-sensing resistor under or near each of the individual heating element;

(ii) connecting one terminal of the temperature-sensing resistor to one terminal of a transistor, connecting the other terminal of the temperature-sensing resistor to an electrode terminal connected with a printer, and connecting the other terminal of the transistor to a ground terminal;

(iii) connecting each transistor corresponding to each temperature-sensing resistor to different transistor switch terminal and ground terminal as a matrix, wherein each pair of a transistor switch terminal and a ground terminal forms a loop from the electrode terminal through the temperature-sensing resistor to ground; and (iv) measuring the resistance of a certain temperature-sensing resistor at the electrode terminal through the choice of transistor switch terminal and ground terminal so that the temperature of the heating element can be obtained.

14. A method as claimed in claim 13 wherein the resistance of the temperature-sensing resistor is larger than 50 ohm at room temperature.

15. A method as claimed in claim 13 wherein at least one of electrode terminals is provided and a maximum number of heating elements that are measured at one time is equal to the number of the electrode terminals.

16. A method for measuring the temperature of an individual heating element of an ink-jet printhead comprising the steps of:

(i) forming a temperature-sensing resistor under or near each of the individual heating element;

(ii) connecting one terminal of the temperature-sensing resistor to one terminal of a transistor, connecting the other terminal of the temperature-sensing resistor to an electrode terminal connected with a printer, and connecting the other terminal of the transistor to a power supply terminal through the heating element;

(iii) connecting each transistor corresponding to each temperature-sensing resistor to a different transistor switch terminal and power supply terminal through the heating element as a matrix, wherein each pair of a transistor switch terminal and a power supply terminal forms a loop from the electrode terminal through the temperature-sensing resistor to ground; and (iv) measuring the resistance of a certain temperature-sensing resistor at the electrode terminal through the choice of transistor switch terminal and power supply terminal so that the temperature of the heating element can be obtained.

17. A method as claimed in claim 16 wherein the resistance of the temperature-sensing resistor is larger than 50 ohm at room temperature.

18. A method as claimed in claim 16 wherein the at least one of electrode terminals is provided and a maximum number of heating elements that can be measured at one time is equal to the number of the electrode terminals.

19. An ink-jet printhead able to measure the temperature of each of individual heating elements comprising:

an ink-jet device for ejecting ink droplets;

a transistor driver for controlling whether the ink-jet device ejects ink droplets; and an interface layer, located between the ink-jet device and the transistor driver, connecting to the transistor driver with a thin line width and connecting to the ink-jet device with a wide line width.

* * * * *